US011681252B2

(12) United States Patent
Itoh

(10) Patent No.: US 11,681,252 B2
(45) Date of Patent: Jun. 20, 2023

(54) IMAGE FORMING APPARATUS

(71) Applicant: CANON KABUSHIKI KAISHA, Tokyo (JP)

(72) Inventor: Isami Itoh, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/750,832

(22) Filed: May 23, 2022

(65) Prior Publication Data

US 2022/0382204 A1 Dec. 1, 2022

(30) Foreign Application Priority Data

May 27, 2021 (JP) ..... JP2021-089374

(51) Int. Cl.
*G03G 15/00* (2006.01)

(52) U.S. Cl.
CPC ..... *G03G 15/5062* (2013.01); *G03G 15/5016* (2013.01); *G03G 2215/00063* (2013.01); *G03G 2215/047* (2013.01)

(58) Field of Classification Search
CPC ..... G03G 15/5016; G03G 15/5054; G03G 15/5058; G03G 15/5062; G03G 2215/00063; G03G 2215/047
See application file for complete search history.

(56) References Cited

U.S. PATENT DOCUMENTS 7,865,096 B2 * 1/2011 Tsunoda ..... G03G 15/0194 399/72
2011/0222869 A1 * 9/2011 Sakatani ..... H04N 1/4078 399/15
2017/0176884 A1 * 6/2017 Miyake ..... G03G 15/043

FOREIGN PATENT DOCUMENTS

JP 2009-192896 A 8/2009

OTHER PUBLICATIONS

Kawatsu, et al. "The IQ-501 Intelligent Quality Optimizer: Simple, Quick, and Precise Color Management," (Imaging Conference Japan 2018 Eps-01) Imaging Society of Japan, Jun. 2018.

* cited by examiner

*Primary Examiner* — Hoang X Ngo
(74) *Attorney, Agent, or Firm* — Venable LLP

(57) ABSTRACT

An image forming apparatus includes an image processor configured to perform image processing on image data based on a conversion condition to output converted image data; an image forming unit configured to form an image based on the converted image data output from the image processor, the image forming unit being controlled based on an image forming condition; and a controller configured to perform tone correction control, density evenness control, and total density control, which is a combination of the tone correction control and the density evenness control. In the tone correction control, the controller controls the image forming unit to form a test image on a sheet and obtains reading data related to the test image on the sheet.

10 Claims, 11 Drawing Sheets

(TEST CHART 3)

(TEST CHART 4)

IMAGE FORMING APPARATUS

BACKGROUND OF THE INVENTION

Field of the Invention

The present disclosure relates to an image forming apparatus, for example, a copying machine, a multifunction peripheral, or a printer.

Description of the Related Art

An image forming apparatus which forms an image by scanning a photoconductor with a laser beam using electrophotographic technology is known. When forming an image by electrophotographic technology, the surface of the photosensitive drum is uniformly charged. Then, the surface of the photosensitive drum is exposed with a laser beam or the like, which is modulated according to an image signal to form an electrostatic latent image. After that, the formed electrostatic latent image is developed with toner to form a toner image. The toner image is transferred on a recording medium material such as paper or the like. The transferred image is melted and fixed by heat by a fixing device to form an image on the recording medium.

In the image forming apparatus described above, a change of tint may occur in a printed output image due to a change in a usage environment such as temperature and humidity, a temporal change, and aging of components due to reduced durability. Further, there are problems such as sensitivity unevenness in a longitudinal direction, which is a main scanning direction of a photoconductor, a reduced output of the laser beam amount irradiated to the photosensitive drum at an end portion, and lens aberration. Even in a case where an exposure device exposes the photoconductor with uniform energy, due to sensitivity unevenness or the like, density unevenness or color unevenness may occur in the image on a transfer sheet depending on the position. In general, the influence of this unevenness in the main scanning direction becomes larger than that in the sub-scanning direction, which is orthogonal to the main scanning direction.

Japanese Patent Application Laid-open No. 2009-192896 proposes a method of generating correction data for correcting the density unevenness in the main scanning direction without being affected by the density unevenness in the sub-scanning direction. A single-page test image, having a constant image density in the main scanning direction and the sub-scanning direction, is generated for multiple pages. The image density varies in steps from page to page. Based on a detection result of a density distribution of the test image on multiple pages, correction data for correcting the density unevenness of the main scanning direction is generated.

In addition, in Imaging Conference JAPAN 2018 Eps-01 (Imaging Society of Japan, Jun. 20, 2018 (Wednesday)), in order to process print jobs efficiently, stably, and with high productivity, a unit, in which a scanner for correction control and a spectroscopic sensor are installed, to be connected to an image forming apparatus has been proposed. Conventional printers have several different adjustment functions, however, some of these adjustment functions interact with each other. Therefore, in order to achieve high quality printing, the user needs to perform a plurality of different adjustment functions in an appropriate order. The unit described in Imaging Conference JAPAN 2018 Eps-01 (Imaging Society of Japan, Jun. 20, 2018 (Wednesday)) has a batch automatic adjustment function which allows a user to make fully automatic adjustments simply by pressing a start button.

In a method disclosed in Japanese Patent Application Laid-open No. 2009-192896, since the number of measurement charts to be output must be equal to the number of tones for measuring the density, in a case where a density detection is performed for a large number of tone values, the number of measurement charts also increases. In practice, it is not desirable to increase the number of measurement charts, therefore, it is desirable to limit the number of measurement charts. However, when the number of measurement charts is limited, the correction data necessary for detecting the density of a large number of tone values cannot be obtained, thus the printed image may have uneven density.

In the unit described in Imaging Conference JAPAN 2018 Eps-01 (Imaging Society of Japan, Jun. 20, 2018 (Wednesday)), the correction controls are sequentially performed in order. However, depending on the order in which each correction control is performed, the process performed by the correction control may affect other processes. As a result, uneven density cannot be corrected with high accuracy, which may result in inaccurate density correction.

One object of the present disclosure is to provide an image forming apparatus that can perform a density correction with high accuracy.

SUMMARY OF THE INVENTION

An image forming apparatus according to the present disclosure includes an image processor configured to perform image processing on image data based on a conversion condition to output converted image data; an image forming unit configured to form an image based on the converted image data output from the image processor, the image forming unit being controlled based on an image forming condition; and a controller configured to perform tone correction control, density evenness control, and total density control, that is combined which is a combination of the tone correction control and the density evenness control, wherein, in the tone correction control, the controller operates so as to: control the image forming unit to form a first test image on a sheet; obtain first reading data related to the first test image on the sheet; determine the image forming condition based on the first reading data; control the image forming unit based on the determined image forming condition to form a second test image on a sheet; obtain second reading data related to the second test image on the sheet; and generate the conversion condition based on the second reading data, and wherein, in the density evenness control, the controller operates as so to: control the image forming unit to form a third test image on a sheet; obtain third reading data related to the third test image on the sheet; and control density evenness of an image to be formed by the image forming unit based on the third reading data, and wherein, in a case where the total density control is performed, the controller controls the image forming unit to form the third test image after the image forming condition is determined based on the first reading data and before the second test image is formed by the image forming unit.

Further features of the present invention will become apparent from the following description of exemplary embodiments (with reference to the attached drawings).

DESCRIPTION OF THE EMBODIMENTS

At least one embodiment of the present disclosure is described with reference to the accompanying drawings. In order to carry out the present disclosure, various technically desirable limitations are added in the embodiments described below, however, the scope of the disclosure is not limited to the following embodiments and exemplary drawings.

Figure 1:
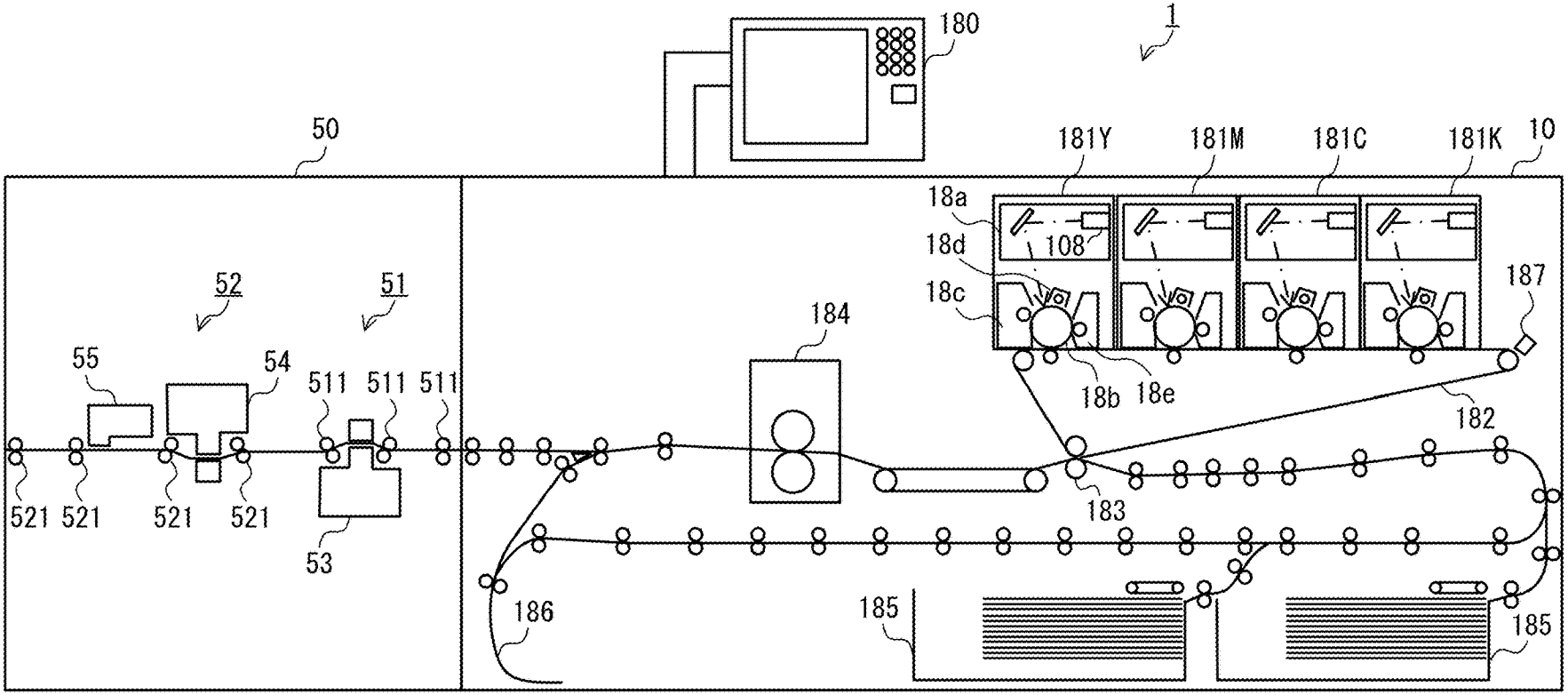
FIG. 1 is a configuration diagram of an image forming system.
Figure 2:
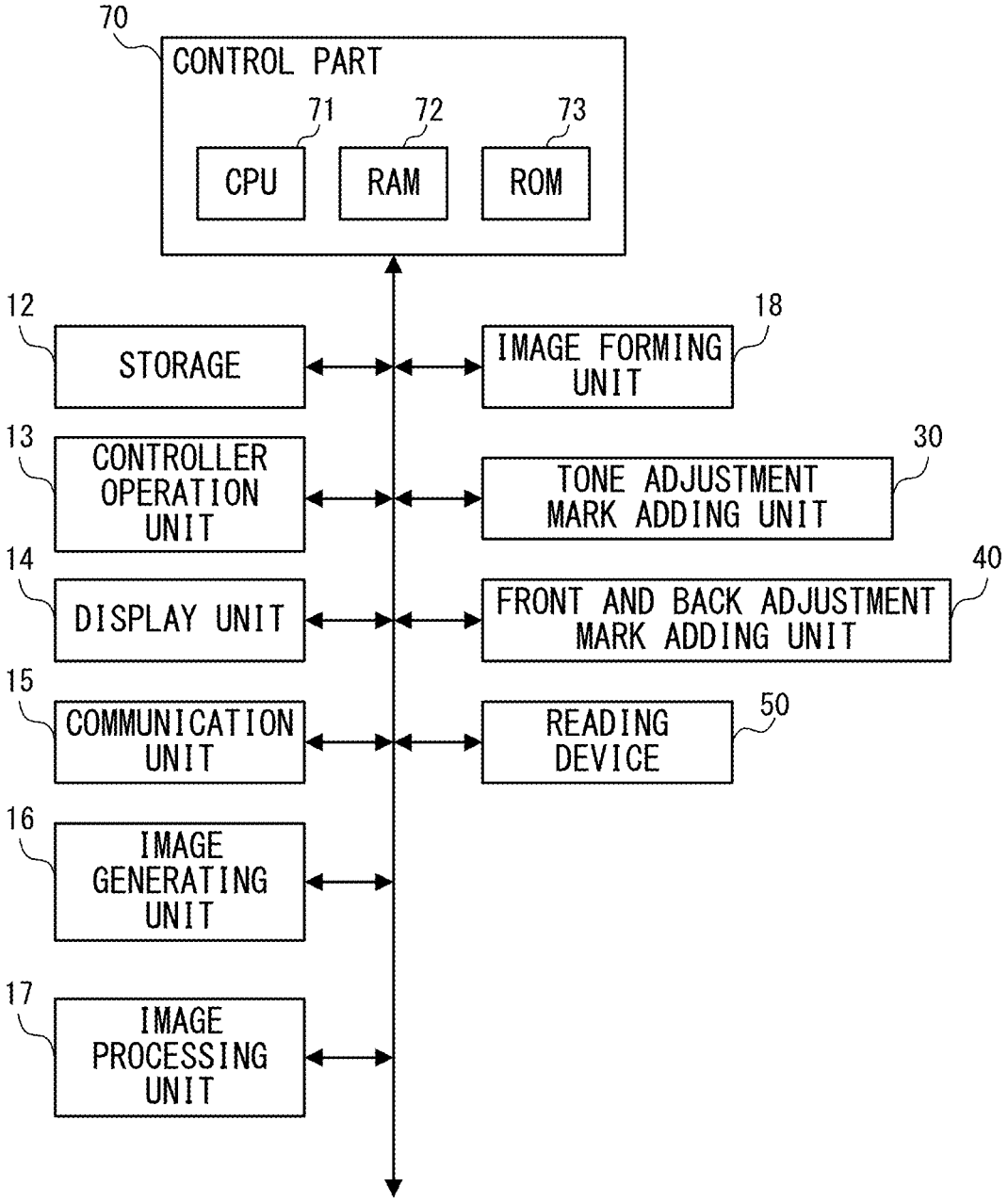
FIG. 2 is a diagram representing a functional block of a controller.

FIG. 1 is a configuration diagram of an image forming system 1 including an image forming apparatus 10 of the present embodiment, and FIG. 2 is a functional block diagram of a controller for controlling the image forming system 1.

As shown, the image forming system 1 includes the image forming apparatus 10, a reading device (scanning unit) 50, and an operation unit 180. The image forming apparatus 10 forms an image on the sheet as a recording medium on which an image is formed. The reading device 50 reads the image formed on the sheet. The operation unit 180 is a user interface having an input device and an output device. The input device includes various key buttons and touch panels. The output device includes displays and speakers. In the present embodiment, the image forming apparatus 10 and the reading device 50 are described as separate devices, but these may be integrally configured. A sheet processing device which performs sheet processing such as stapling, hole punching, folding, and bookbinding may be provided on the downstream side of the sheet conveyance direction of the reading device 50.

FIG. 2 shows a diagram representing the functional block of the controller. As shown, the controller includes a storage 12, a controller operation unit 13, a display unit 14, a communication unit 15, an image generating unit 16, an image processing unit 17, an image forming unit 18, a tone adjustment mark adding unit 30, a front/back adjustment mark adding unit 40, and a control part 70. The control part 70 controls the operation of each part which constitutes the image forming system 1. The control part 70 includes a CPU (Central Processing Unit) 71, a RAM (Random Access Memory) 72, and a ROM (Read Only Memory) 73. The CPU 71 controls the operation of each unit of the image forming system 1 by executing a computer program stored in the ROM 73 or the storage 12. The RAM 72 provides a work area which is used when the CPU 71 executes processing and temporarily stores various programs, data, and the like. In the present embodiment, a tone adjustment mark and a front/back adjustment mark are used, but are not limited to these marks and any image can be used for the tone adjustment and the front/back adjustment. For example, a tone adjustment image and a front/back adjustment image may be used as the tone adjustment mark and the front/back adjustment mark.

Hereinafter, the details of the image forming apparatus 10 will be described. The control part 70 of the controller determines whether or not to control the image forming apparatus 10 to form the tone adjustment mark to overlap with the image area of the image to be formed on the sheet. When it is determined to form the tone adjustment mark to overlap with the image area, the control part 70 controls the image forming apparatus 10 to add tone adjustment mark information to the image data to form the tone adjustment mark. Further, the control part 70 monitors and adjusts a tone characteristic based on a scan result of the sheet on which the tone adjustment mark has been formed.

The storage 12 stores a program which can be read by the control part 70 and a file which is used when the program is executed and the like. In addition, the storage 12 stores the values calculated or obtained in monitoring and adjusting the tone characteristic and in the front/back adjustment, which will be described later. As the storage 12, a large-capacity memory such as a hard disk can be used.

The communication unit 15 communicates with a user terminal, a server, and other external devices on the network such as image forming peripherals. For example, the communication unit 15 receives data (hereinafter referred to as PDL data) described in a page description language (PDL) from a user terminal via a network.

The image generating unit 16 rasterizes the PDL data received by the communication unit 15 to generate, for each color of Y (yellow), C (cyan), M (magenta), and K (black), bitmap format image data having a tone value for each pixel. The tone value is a data value representing a shade of an image, and for example, an 8-bit data value represents a shade of 0 to 255 tones.

The image processing unit performs image processing such as a color correction process and a halftone process on the image data generated by the image generating unit 16. Further, the image processing unit performs color conversion of the image data of R (red), G (green), and B (blue) generated by the image reading unit 161 to generate image data of each color of Y, M, C, and K.

A color correction process is a process to convert the tone value of each color of Y, M, C, and K into the tone value which is corrected such that the color of the image formed on the sheet matches the target color of Y, M, C, and K. In the color correction process, the tone correction table in which an output tone value corresponding to an input tone value is defined is used. The image processing unit performs the color correction process of the tone adjustment mark in a case where the correction is enabled by the control part 70 as described later. In a case where the correction is disabled by the control part 70, the image processing unit performs the halftone process without performing the color correction process of the adjustment mark. The halftone process is, for example, an error diffusion process, a screen process using a systematic dither method, or the like.

The image forming unit 18 forms an image which consists of a plurality of colors on the sheet according to the tone value of each pixel of the image data for which image processing has been performed by the image processing unit. Further, in the present disclosure, the image forming unit 18 forms an image on the sheet based on the image data to which the tone adjustment mark information and the front/back adjustment mark information, which will be described later, are added. In this embodiment, the image is centered on the sheet. As shown in FIG. 1, the image forming unit 18 has four image forming units 181Y, 181M, 181C, and 181K, an intermediate transfer belt 182, a secondary transfer roller 183, a fixing device 184, two feeding trays 185, an inversion mechanism 186 and an optical sensor 187.

The image forming units 181Y, 181M, 181C, and 181K are arranged in series along the belt surface of the intermediate transfer belt 182. The intermediate transfer belt 182 is wound around a plurality of rollers to rotate in a predetermined direction (clockwise in FIG. 1 in this embodiment). The secondary transfer roller 183 and the fixing device 184 are arranged on a sheet conveyance path of the sheet conveyed from the feeding tray 185. The feeding tray 185 stores sheets of a predetermined size. In the present embodiment, two feeding trays 185 are provided, and the sheets stored in each of the feeding trays 185 may be of the same type or different types.

The image forming unit 181Y forms an image of yellow (Y). The image forming unit 181M forms an image of magenta (M). The image forming unit 181C forms an image of cyan (C). The image forming unit 181K forms an image of black (K). Each image forming unit has the same configuration and includes an exposure unit 18*a*, a photoconductor 18*b*, a developing unit 18*c*, a charging unit 18*d*, and a cleaning unit 18*e*, respectively. The photoconductor 18*b* is a drum-shaped image bearing member having a photosensitive layer on its surface. The photoconductor 18*b* rotates counterclockwise in the figure about the drum axis. The charging unit 18*d* applies a voltage to the photosensitive layer of the rotating photoconductor 18*b* to uniformly charge the surface of the photoconductor 18*b*.

Next, an electrostatic latent image is formed on each photoconductor. When each image forming unit 181 supplies a color material such as toner by the developing unit 18*c* to develop an electrostatic latent image formed on the photoconductor 18*b*, an image of each color is formed on the photoconductor 18*b* of each image forming unit 181. Hereinafter, toner is used as the color material.

The image on each photoconductor 18*b* is sequentially superimposed and transferred on the intermediate transfer belt 182 to thereby form an image composed of a plurality of colors on the intermediate transfer belt 182. After the image is transferred, each image forming unit 181 removes the toner remaining on the photoconductor 18*b* by the cleaning unit 18*e*.

Depending on the timing at which the image formed on the intermediate transfer belt 182 is conveyed, due to the rotation of the intermediate transfer belt 182, to the secondary transfer roller 183, the sheet is conveyed from the feeding tray 185 to the secondary transfer roller 183. The secondary transfer roller 183 serves as a unit to transfer the image from the intermediate transfer belt 182 on the sheet. The sheet on which the image is transferred is conveyed to the fixing device 184. The fixing device 184 fixes the image on the sheet by heating and pressurizing the sheet on which the image has been transferred. In a case where an image is formed on one side of the sheet, the image forming processing is completed. In a case where an image is formed on both sides of the sheet, the sheet on which the image has been formed on one side is conveyed from the fixing device 184 to the inversion mechanism 186 to invert the front/back surfaces. After the front/back surfaces are inverted, the sheet is conveyed to the secondary transfer roller 183 again, and an image is formed in the same way.

The tone adjustment mark adding unit 30 adds test image data to the image data so that the tone adjustment mark is formed. The front/back adjustment mark adding unit 40 adds front/back adjustment mark data to the image data so that the front/back adjustment mark is formed.

As shown in FIG. 1, the reading device 50 is provided on the downstream side of the sheet the control direction of the image forming apparatus 10. In the present embodiment, the reading device 50 includes a first conveyance unit 51, a second conveyance unit 52, a first sensor 53, a second sensor 54, and a colorimetric unit 55. The reading device 50 has a configuration in which both sides can be simultaneously scanned by the first sensor 53 and the second sensor 54 in a case where an image is formed on each side of the sheet by the image forming unit 18. The scan result of the tone adjustment mark and the front/back adjustment mark by the reading device 50 is stored in the above-mentioned storage 12 or the RAM 72 of the control part 70, and is analyzed by the control part 70.

The first conveyance unit 51 has a plurality of conveyance roller pairs 511 for conveying the sheet supplied from the image forming apparatus 10. The second conveyance unit 52 has a plurality of conveyance roller pairs 521 for conveying the read sheet. The first sensor 53 and the second sensor 54 are arranged at positions sandwiching the sheet conveyance path through which the sheet is conveyed. Therefore, the reading device 50 can read the images on both sides of the sheet by the first sensor 53 and the second sensor 54 in a single conveyance.

The first sensor 53 is arranged in the first conveyance unit 51, and reads the image on the sheet passing through the first conveyance unit 51 from the below side. The first sensor 53 is, for example, an optical sensor such as a line scanner which can read at a relatively high speed, and reads an image formed on the sheet to output a read signal of each color of R (red), G (green), and B (blue). The first sensor 53 is, for example, an optical sensor such as CMOS (Complementary Metal Oxide Semiconductor) line sensor, CCD (Charge Coupled Device) line sensor, or the like. In the present embodiment, by using, as the first sensor 53, a sensor such as a line scanner capable of reading the image on the sheet at a relatively high speed, the reading speed is faster than that of the colorimetric unit 55 described later. The colorimetric unit 55 is a colorimeter in this embodiment.

Further, the first sensor 53 can read a wider range in the width direction of the sheet as compared with the colorimetric unit 55, and can read the entire width direction of the sheet.

The second sensor 54 is arranged in the second conveyance unit 52, and reads the image on the sheet passing through the second conveyance unit 52 from the above side. In the present embodiment, the second sensor 54 is configured in the same manner as the first sensor 53, and outputs a reading signal of each color of R (red), G (green), and B (blue) as a reading result. The colorimetric unit 55 is configured to have a spectroscopic type color sensor.

The colorimetric unit 55 is arranged on the downstream side in the sheet passing direction with respect to the second sensor 54. The colorimetric unit 55 reads an image of the other surface of the sheet passing through the second conveyance unit 52. The colorimetric unit 55 spectrally measures the color of the tone adjustment image formed on the sheet and obtains colorimetric data. The colorimetric data is represented by a color system such as XYZ.

Here, as described above, an optical sensor 187 is provided in the vicinity of the intermediate transfer belt of the image forming apparatus 10 in FIG. 1. In order to detect the image formed on the intermediate transfer belt 182 by specular light, the optical sensor 187 has a high-precision resolution in a lower density region (highlighted region) as compared with the first sensor 53 and the second sensor 54 which detect the image formed on the sheet. The first sensor 53 and the second sensor 54 of the reading device 50 have a high-precision resolution in a higher density region as compared with the optical sensor 187 in order to detect the image formed on the sheet. When each sheet is detected by the first sensor 53 or and the second sensor 54 on the margin of each sheet, the resolution of the intermediate density region becomes higher, as compared with the optical sensor 187. Therefore, in the present embodiment, the adjustment of the tone characteristic in the highlighted region is performed by the tone adjustment image formed on the intermediate transfer belt 182, and the adjustment of the tone characteristic in the density region other than the highlight region is performed by using the tone adjustment image formed on the sheet.

Figure 3:
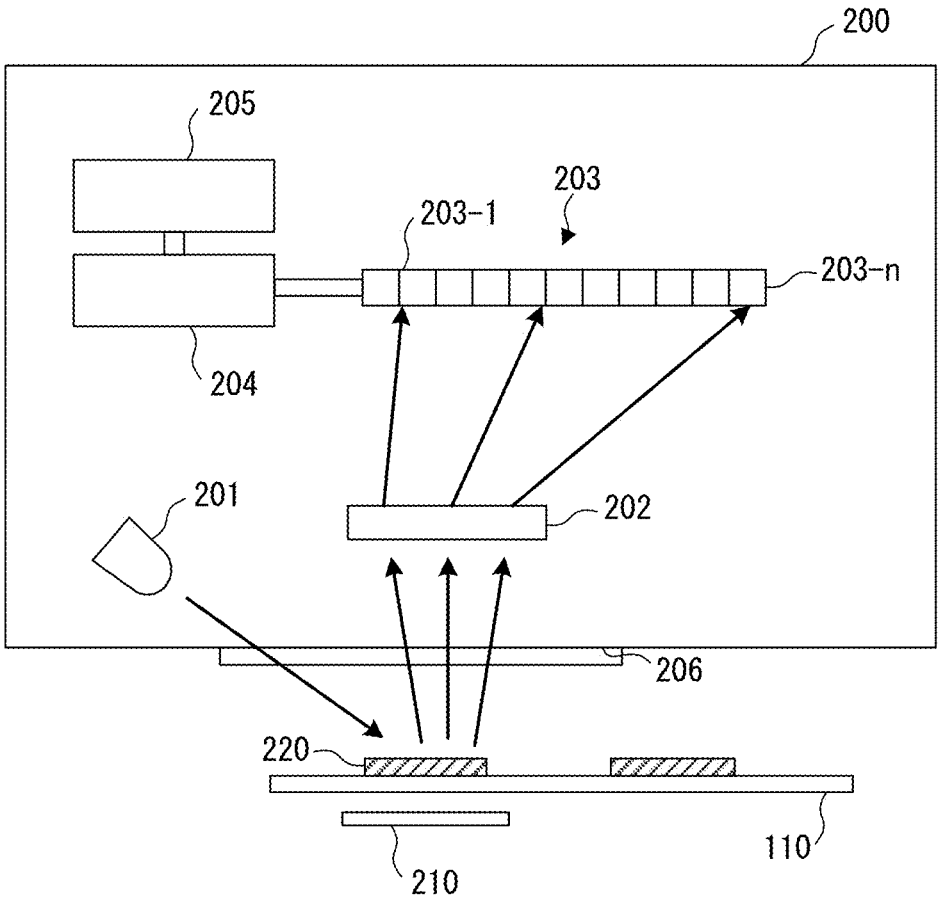
FIG. 3 is a diagram representing an exemplary configuration of a spectral sensor.

FIG. 3 is a diagram representing a structural example of a spectroscopic sensor 200 in the colorimetric unit 55 as the reading unit according to the present embodiment. The spectroscopic sensor 200 includes a white LED 201, a diffraction grating 202, a line sensor 203, a calculation unit 204, a memory 205, and a reference plate 210. The white LED 201 irradiates a color measurement target (here, the toner patch 220) on the printing media 110 with light. The white LED 201 serves as an irradiation unit which irradiates a measurement image with light. The diffraction grating 202 disperses the reflected light reflected from the toner patch 220 for each wavelength. The line sensor 203 is composed of n pixels (203-1 to **203-*n*), and the light dispersed for each wavelength by the diffraction grating 202** is detected by each pixel.

The line sensor 203 serves as a light receiving unit which receives the reflected light from the measurement image. The calculation unit 204 performs various calculations from the light intensity value of each pixel detected by the line sensor 203. The calculation unit 204 has, for example, a density calculation unit (not shown) that calculates the density from the light intensity value, an Lab calculation unit (not shown) which calculates an Lab value, and the like. The memory 205 stores various data. The reference plate 210 is irradiated by the white LED 201 in order to adjust the reference value in the spectroscopic sensor 200, and the reflected light is detected by the line sensor 203 to obtain a value to be a reference. The spectroscopic sensor 200 serves as a measuring unit for measuring a sensor signal value related to a light intensity value of reflected light from a measurement image received by each pixel (light receiving element) of the line sensor 203.

Further, as to the configuration of the spectroscopic sensor 200, a lens 206 may be built-in. In this configuration, the light emitted from the white LED 201 is collected on the toner patch 220 on the printing media 110, and the lens 206 collects the light reflected from the toner patch 220 on the diffraction grating 202. For the line sensor 203, for example, a CMOS sensor may be used.

The tone correction control using the spectroscopic sensor 200 will be described. As shown in the flow chart of FIG. 5, in the present embodiment, in the tone correction control, a tone correction process is performed after the maximum density adjustment is performed. In order to form constantly and stably an image having a desired density and tone on the sheet based on the image data, it is necessary to maintain color stability in the image. Therefore, the image forming apparatus 10 outputs a toner patch image on the printing media in a timely manner so that the tone of a desired density can always be obtained. Further, the image forming apparatus 10 performs desired density adjustment and the tone adjustment by measuring information of the output image.

Figure 4:
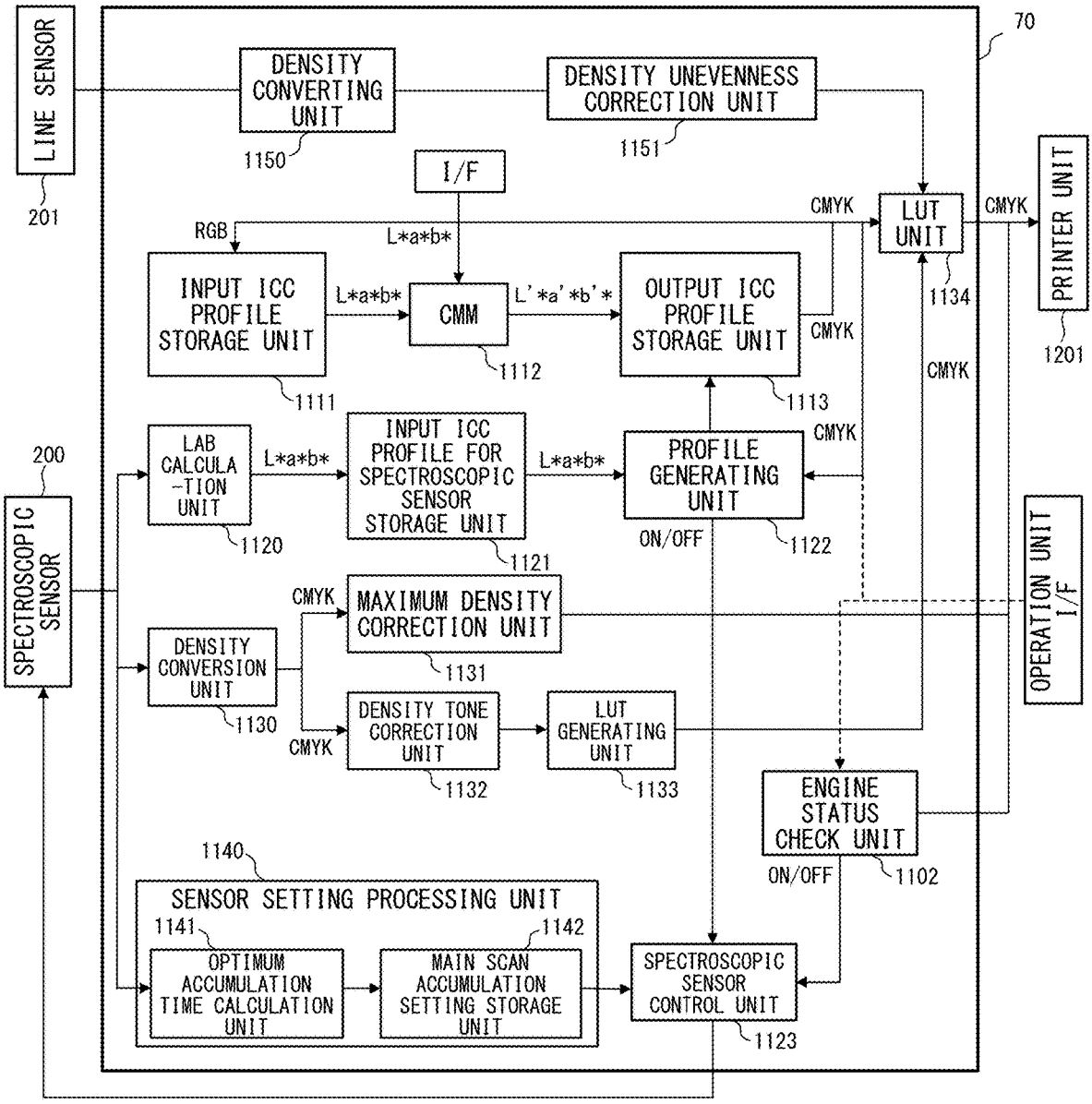
FIG. 4 is a diagram representing a functional block of an image forming apparatus.

FIG. 4 is a diagram representing a functional block of an image forming apparatus 10. In the image forming apparatus, the CPU 71 expands programs stored in the ROM 73 in the control part 70 into the RAM 72 and executes the programs to form the functions shown in FIG. 4. With the functions formed in this way, a conversion process and a calculation process of input data are performed under the control of the CPU 71.

As shown, in the image forming apparatus 10, the result measured by the spectroscopic sensor 200 is also sent to the Lab calculation unit 1120 as spectral reflection factor data. The Lab calculation unit 1120 converts the spectral reflection factor data into L*a*b*data. Further, the converted L*a*b data is input to the profile generating unit 1122 through an input ICC profile for spectroscopic sensor storage unit 1121. The profile generating unit 1122 generates an ICC profile based on the input ICC profile for the spectroscopic sensor stored in the input ICC profile for spectroscopic sensor storage unit 1121, L*a*b*data, CMYK signal values, and the like. The generated ICC profile is stored in an output ICC profile storage unit 1113. The output ICC profile storage unit 1113 serves as a conversion unit for converting image data based on an ICC profile in order to adjust the color tone of the image formed by the image forming apparatus 10.

The CMM 1112 performs a color conversion using an input profile stored in the input ICC profile storage unit 1111 and an output profile stored in the output ICC profile storage unit 1113. The spectroscopic sensor 200 transmits the measurement result for each patch to the sensor setting processing unit 1140. Here, the sensor setting processing unit 1140 includes an optimum accumulation time calculation unit 1141 and a main scan accumulation setting storage unit 1142. The optimum accumulation time calculation unit 1141 determines an optimum storage setting for each patch based on the measurement result of each patch. The optimum accumulation time calculation unit 1141 stores the calculated optimum accumulation setting in the main scan accumulation setting storage unit 1142 in order to reflect the calculated optimum storage setting at the time of the main scan. The control part 70 reads out the accumulation setting stored in the main scan accumulation setting storage unit 1142, and outputs, to a spectroscopic sensor control unit 1123, a signal for controlling the spectroscopic sensor 200 to perform the main scan and an optimum accumulation time of each patch. The spectroscopic sensor control unit 1123 controls the spectroscopic sensor 200 based on the input optimum accumulation time and the like.

Figure 5:
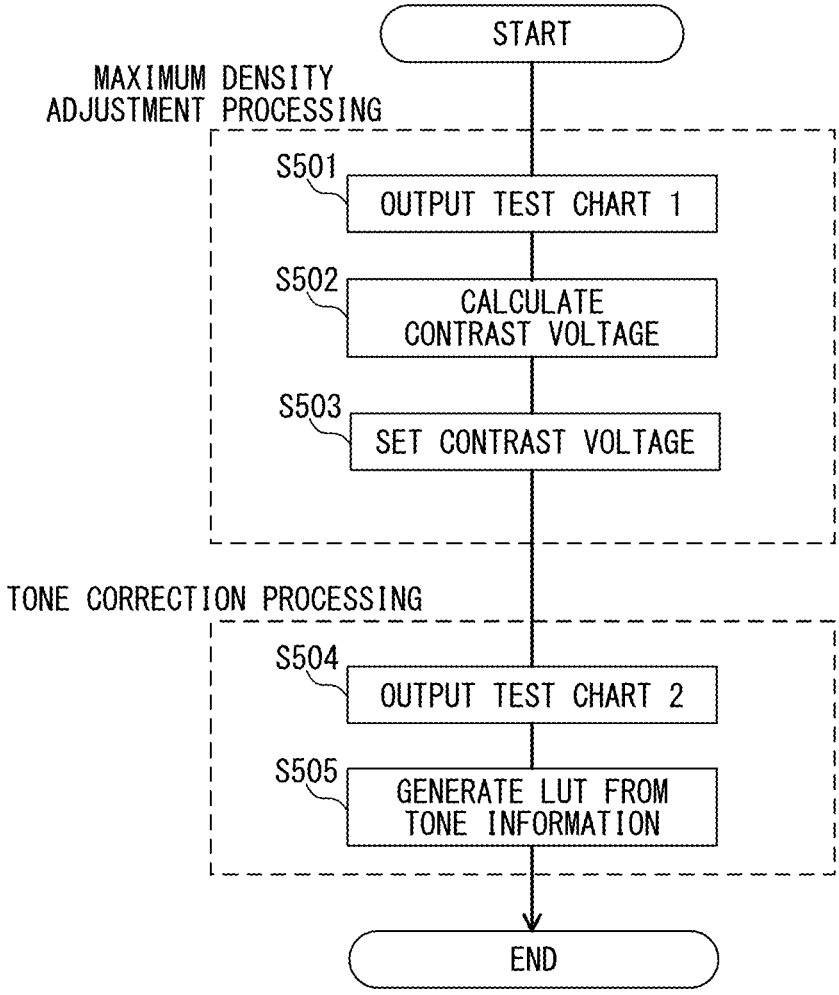
FIG. 5 is a flow chart representing a tone correction control process.

FIG. 5 is a flow chart representing a process executed by the tone correction control of the present embodiment. In the present embodiment, in the image forming apparatus 10, a plurality of corrections including a tone correction control and a density unevenness correction control are performed, and, in a tone control, a maximum density adjustment process and a tone correction process are performed. The maximum density adjustment process is a process executed before the tone correction process. Hereinafter, a process executed before the tone correction process, such as the maximum density adjustment process, is described as "preprocessing". The tone correction control will be described with reference to FIG. 4 and FIG. 5. Unless otherwise specified, each step shown in FIG. 5 is executed under the control of the CPU 71 of the control part 70.

When the tone correction control is started, as shown in FIG. 4, through an operation unit interface (operation unit I/F) of the operation unit 180, an instruction for a maximum density adjustment process is input to an engine status check unit 1102. The engine status check unit 1102 outputs measurement image data for outputting a test chart 1 (measurement image) for obtaining density information in a current engine state, and the measurement image is output by the image forming apparatus 10.

On the other hand, the control part 70 sends a colorimetric analysis instruction to the spectroscopic sensor control unit 1123 when the tone spectroscopy control is started. At this time, as shown in FIG. 5, the control part 70 outputs the test chart 1 using a voltage setting, an exposure setting, and a development setting determined in advance or at the time of the previous correction (Step S501).

Figure 6A:
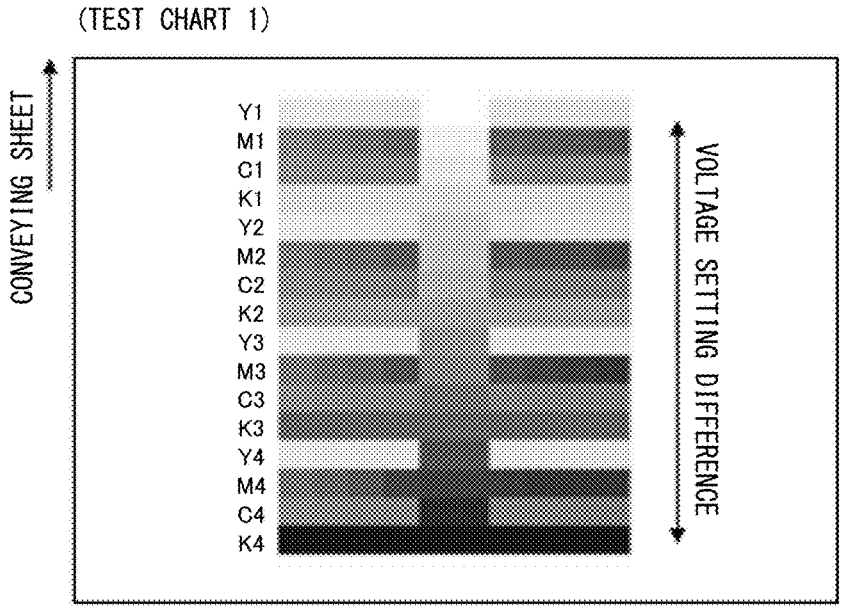
FIG. 6A and FIG. 6B are explanatory diagrams of a test chart.

FIG. 6A is an explanatory diagram of the test chart 1. In FIG. 6A, Y1, Y2, Y3, and Y4 each represent yellow, and the magnitude relationship between their densities is expressed as Y1<Y2<Y3<Y4. M1, M2, M3, and M4 each represent magenta, and the magnitude relationship between their densities is expressed as M1<M2<M3<M4. C1, C2, C3, and C4 each represent cyan, and the magnitude relationship between their densities is expressed as C1<C2<C3<C4. K1, K2, K3 and K4 each represent black, and the magnitude relationship between their densities is expressed as K1<K2<K3<K4.

The output test chart 1 is arranged at a colorimetric analysis position of the spectroscopic sensor 200, and a colorimetric analysis is performed by the spectroscopic sensor 200. The colorimetric analysis result is sent to a density conversion unit 1130 as spectral reflection factor data. The density conversion unit 1130 performs a density calculation and sends the conversion result as CMYK density data to a maximum density correction unit 1131. For obtaining a desired maximum density, the maximum density correction unit 1131 calculates a contrast voltage (Step S502), sets the contrast voltage (Step S503), and calculates a correction amount of the exposure setting and the development setting, and corrects the maximum density. The maximum density value calculated in this way is stored in the RAM 72.

Figure 7A:
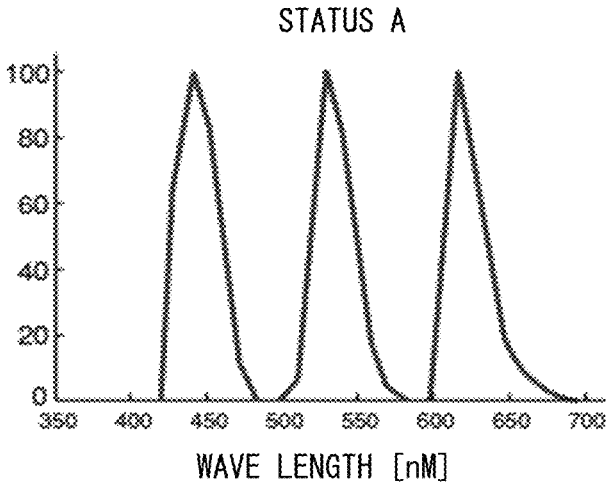
FIG. 7A and FIG. 7B are explanatory diagrams of a filter used for a conversion operation.
Figure 7B:
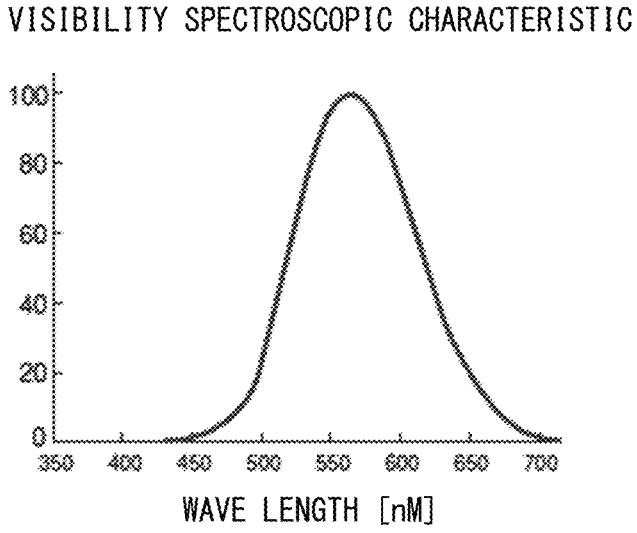

Filters used in the conversion operation to density values are shown in FIG. 7A and FIG. 7B. The CMYK density is calculated using a status A filter shown in FIG. 7A for the obtained spectral reflection factor of each wavelength and using a visibility spectroscopic characteristic (also referred to as Visual) as shown in FIG. 7B for black. The density conversion unit 1130 converts the spectral reflection factor of the cyan measurement image into density using the status A filter shown in FIG. 7A. Similarly, when determining the density of a magenta measurement image or a yellow measurement image, the density conversion unit 1130 converts the spectral reflection factor of the measurement image into density using the status A filter shown in FIG. 7A. On the other hand, when determining density of the black measurement image, the density conversion unit 1130 converts the spectral reflection factor of the measurement image into density using the visibility spectroscopic characteristic (also referred to as Visual) shown in FIG. 7B.

Next, the tone correction processing (the tone correction control) will be described. After executing the maximum density adjustment process, the control part 70 outputs a signal to the printer unit 1201 to generate a tone pattern when an instruction for the tone correction process is input. This tone pattern includes a maximum density patch formed by using the voltage setting, the exposure setting, and the development setting previously determined by the maximum density correction unit 1131. A correction by a density unevenness correction, which will be described later, is applied to the formed tone pattern. In the present embodiment, the control part 70 outputs a test image as a tone pattern. In this embodiment, a test chart 2 is output as a test image (Step S504).

Figure 6B:
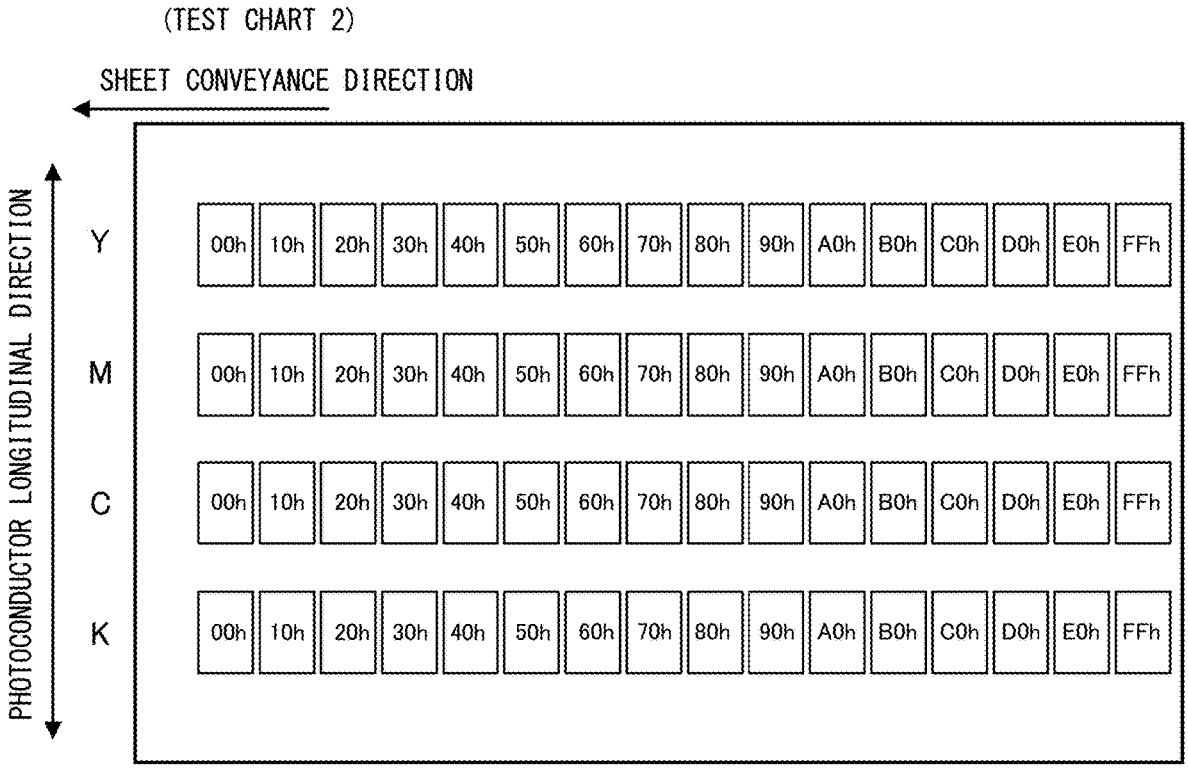

The test chart 2 is shown in FIG. 6B. As shown, the test chart 2 is a 16-levels tone pattern of an A3 size, and each tone is represented as 00h, 10h, 20h, 30h, 40h, 50h, 60h, 70h, 80h, 90h, A0h, B0h, C0h, D0h, E0h, and FFh. Further, the control part 70 sends a colorimetric analysis instruction to the spectroscopic sensor control unit 1123. The generated tone pattern is placed at the colorimetric analysis position of the spectroscopic sensor 200, and the colorimetric analysis is performed by the spectroscopic sensor 200. As described above, in the test chart 2, an image having uniform tone in a longitudinal direction of the photoconductor and having a plurality of tone levels (here, 16 levels) is formed in a rotation direction (i.e., the sheet conveyance direction) of the photoconductor.

The colorimetric analysis result is sent to the density conversion unit 1130 as spectral reflection factor data. The density conversion unit 1130 performs the density calculation as described above, and sends the calculation result to the density tone correction unit 1132 as CMYK density data for each density. The density tone correction unit 1132 obtains a correspondence relationship between the input data and the output data concerning the color density so that the desired tone property is obtained. This correspondence relationship can be expressed by, for example, a LUT (Look Up Table). In the present embodiment, a tone LUT representing this correspondence relationship is generated (Step S505), and the generated single-color tone LUT is sent to the LUT unit 1134 as a signal value of each CMYK color.

Next, the density unevenness correction control (the density evenness control) will be described. A density conversion unit 1150 and a density unevenness correction unit 1151 shown in FIG. 4 perform the density unevenness correction control in the longitudinal direction of the photoconductor using an image read by the line sensor 203 in the first sensor 53. In the density unevenness correction control, the density unevenness correction control in the longitudinal direction of the photoconductor by laser power and the correction using the image signal values of each tone are performed by the control part 70.

Figure 8:
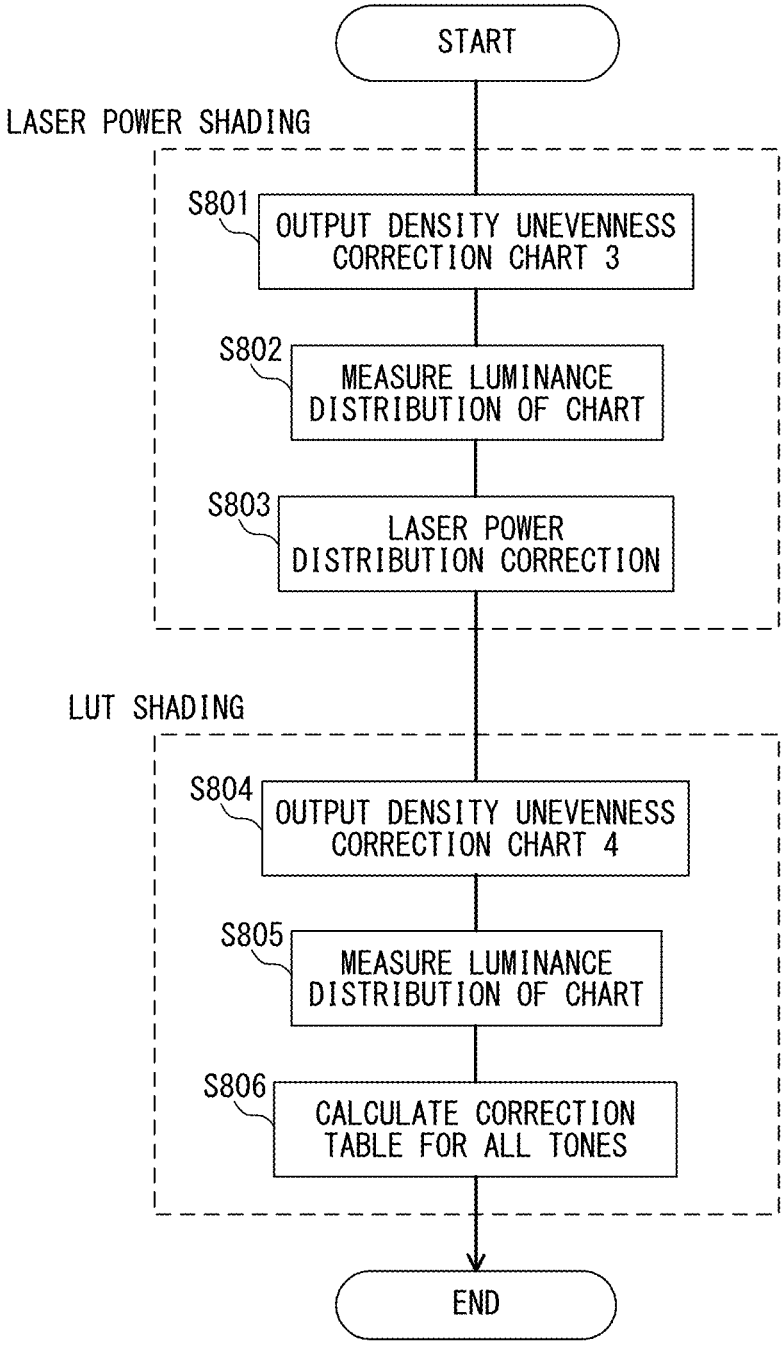
FIG. 8 is a flow chart for representing a density unevenness correction control.

FIG. 8 is a flow chart representing the density unevenness correction control. Unless otherwise specified, the process represented in FIG. 8 is performed under the control of the control part 70. In FIG. 8, Steps S801 to S803 represent the density unevenness correction control (laser power shading) in the longitudinal direction of the photoconductor by laser power. Further, Steps S804 to S806 represent correction (LUT shading) using the image signal values of each tone.

Figure 9A:
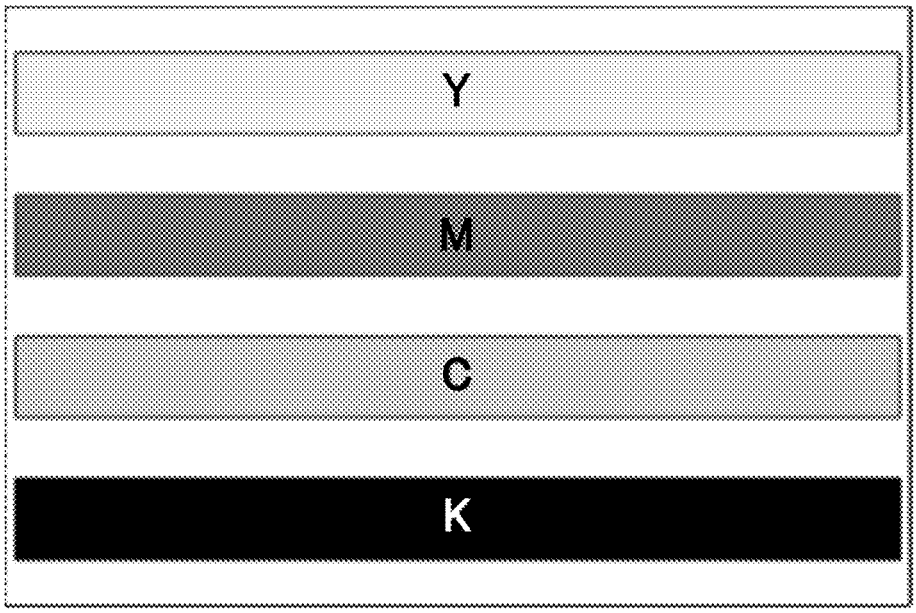
FIG. 9A and FIG. 9B are explanatory diagrams of test charts.
Figure 9B:
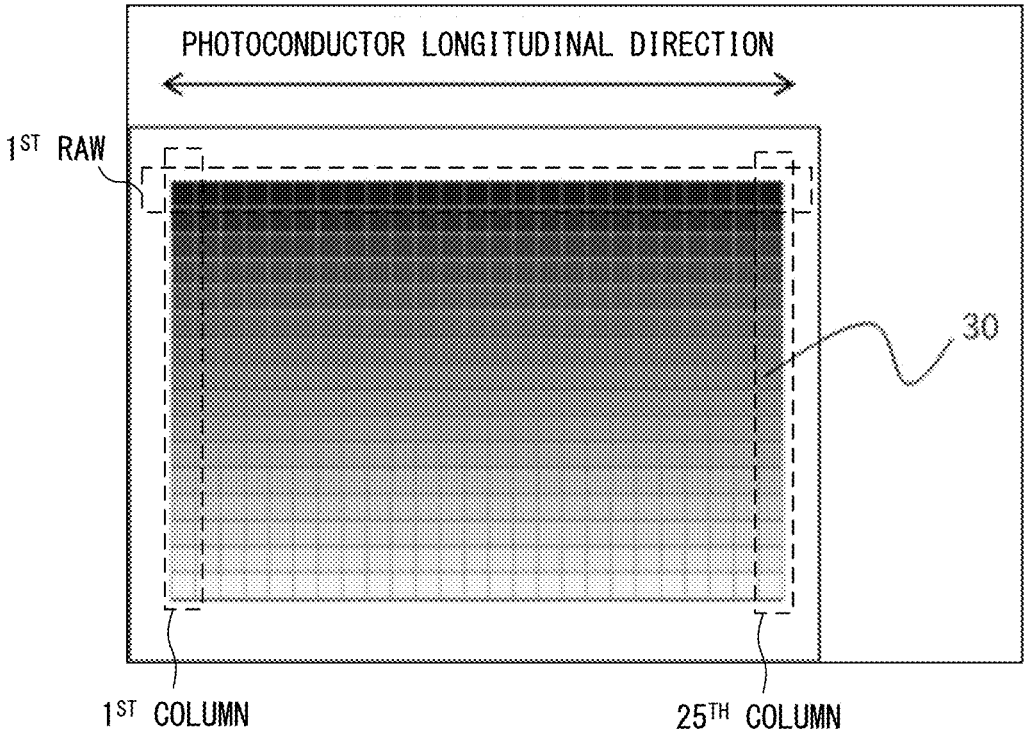

Further, FIG. 9A and FIG. 9B represent a test chart 3 and a test chart 4 used in the density unevenness correction control, respectively. In the test chart 3, a band-shaped portion Y represents a yellow printed portion extending in the longitudinal direction of the photoconductor and having a uniform density. A band-shaped portion M represents a magenta printed portion extending in the longitudinal direction of the photoconductor and having a uniform density. A band-shaped portion C represents a cyan printed portion extending in the longitudinal direction of the photoconductor and having a uniform density. A band-shaped portion K represents a black printed portion extending in the longitudinal direction of the photoconductor and having a uniform density.

In this embodiment, each band-shaped portion Y, M, C, and K of the test chart 3 targets a density of 1.2±0.2. In the test chart 4, the black square print area is printed in 16 rows*25 columns with the photoconductor longitudinal direction as rows and the photoconductor rotation direction as columns. These figures represent the first row in which the print areas are arranged in the longitudinal direction of the photoconductor, and the first column and the 25th column in which the print areas are arranged in the rotation direction of the photoconductor. In each row, the density of each printed area aligned in the longitudinal direction of the photoconductor is uniform.

On the other hand, in each row, the print areas arranged in the direction of rotation of the photoconductor have the highest density on an upper side of the sheet surface, and the density becomes lower toward the lower side of the sheet surface. Therefore, in the test chart 4, a plurality of tones are output, and in the present embodiment, black is output in 16 tones. Further, in order to measure the density unevenness in the longitudinal direction of the photoconductor, a plurality of print rows are formed in the longitudinal direction of the photoconductor such that print areas are formed over the entire longitudinal direction of the sheet. In the test chart 4 of FIG. 9B, 25 rows of print areas are formed to form print areas in the entire longitudinal direction.

Referring to FIG. 8, when the density unevenness correction control is started, the control part 70 transmits the image signals corresponding to the band-shaped portions Y, M, C, and K of the test chart 3 via the engine status check unit 1102 to the image forming apparatus 10 (Step S801). The control part 70 reads an output brightness distribution of the test chart 3 with the first sensor 53 (Step S802) to correct the light amount distribution (laser power distribution) of the exposure light amount in the longitudinal direction of the photoconductor based on the read brightness distribution data (Step S803). Therefore, the control part 70 operates as a correction data generating unit for generating correction data for correcting the density unevenness in the longitudinal direction of the photoconductor for each tone. From these brightness and brightness distributions, the density and density distribution of the test chart 3 can be obtained.

Further, the control part 70 outputs the input value of the image signal corresponding to the test chart 4 to the image forming apparatus 10 via the engine status check unit 1102 (Step S804). Then, the first sensor 53 measures the brightness distribution in the output value in the longitudinal direction of the photoconductor of each tone of the test chart 4 output from the image forming apparatus 10 (Step S805). Further, the control part 70 calculates the correction data for correcting the image signal value so as to reduce the unevenness of the longitudinal density of the photoconductor for each measured tone (Step S806). As described above, the control part 70 also operates as a correction unit for correcting the density unevenness based on the correction data generated by the operation as the correction data generating unit as described above. The format of this correction data is not limited, and any format can be used. The control part 70 calculates the correction data for correcting the image signal value to reduce the unevenness of the density in the longitudinal direction of the photoconductor for each measured tone. Further, in the density unevenness correction control, the image signal value is corrected so as to reduce the unevenness of the longitudinal density of the photoconductor. Therefore, in a case where the density unevenness correction control of Steps S801 to S806 is executed after the tone correction process performed in Steps S504 to S505, the tone LUT generated in Step S505 may be affected.

Figure 10A:
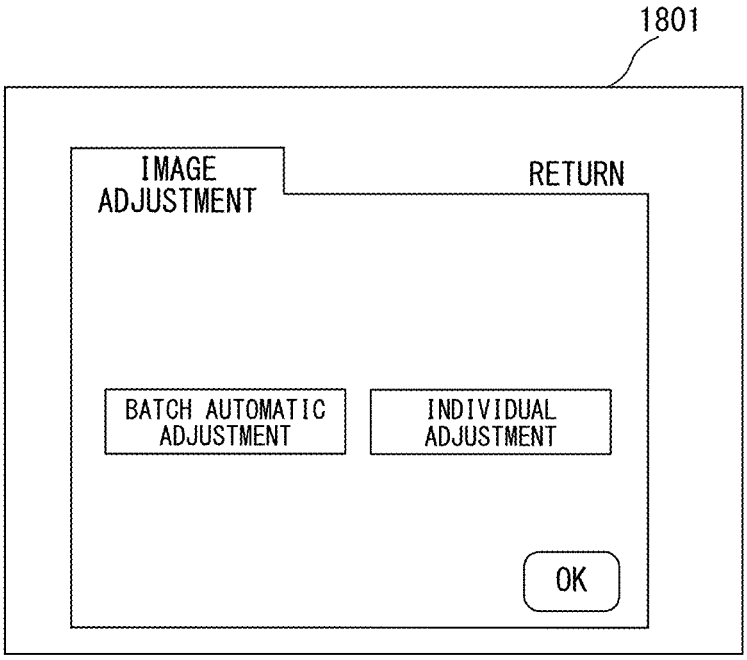
FIG. 10A and FIG. 10B are explanatory diagrams of an operation panel.
Figure 10B:
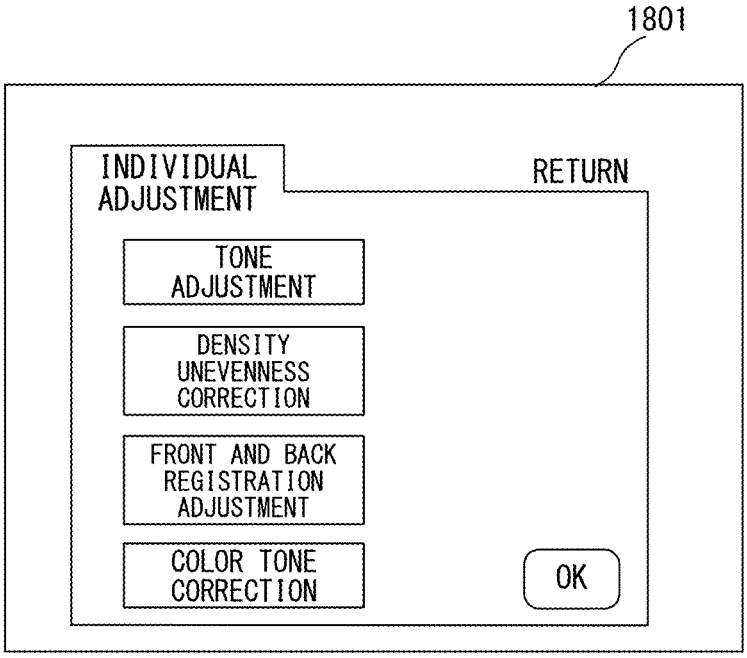

An example of the tone correction control executed by the control part 70 in the image forming system configured as above will be described. FIG. 10A and FIG. 10B are explanatory diagrams of an operation panel 1801 of the operation unit 180. In the image forming apparatus 10, various correction processes in the image forming can be performed, and the user can select and perform various correction processes through the selection screen. In FIG. 10A, a batch automatic adjustment and an individual adjustment are displayed on the operation panel 1801, and the user can select either of them.

When the user selects individual adjustment, as shown in FIG. 10B, individual correction processes such as the tone correction, the density unevenness correction, a front/back registration adjustment, and a color tone correction are shown. The user selects one of these correction processes and causes the image forming apparatus 10 to perform the selected correction process. When the user selects the tone correction, the control part 70 performs the Steps S501 to S505 shown in FIG. 5, so that the tone correction control is performed. Further, when the user selects the density unevenness correction, the control part 70 performs the density unevenness correction control shown in Steps S801 to S806 of FIG. 8.

When the user selects batch automatic adjustment in FIG. 10A, the tone correction control and the density unevenness correction control are sequentially performed. Here, in a case where the tone correction control and the density unevenness correction control are sequentially performed with the same process content which is performed when the individual adjustment is selected, the density unevenness may not be suppressed with sufficient accuracy. As described above, in the tone correction control, a single color tone LUT representing the correspondence relationship between the input data and the output data is generated in Step S505. On the other hand, in the density unevenness correction control, in Step S806, a correction table is calculated in order to correct the image signal value such that the density unevenness in the longitudinal direction of the photoconductor is reduced. Therefore, in a case where the density unevenness correction control is performed in the longitudinal direction of the photoconductor after the tone direction control, the image signal is corrected by the LUT generated in Step S806 of the density unevenness correction control, a tone shift may occur. As a result, the uniformity of the tone may be decreased. As described above, in a case where the tone correction control and the density unevenness correction control are sequentially performed with the same process content which is performed when the individual adjustment is performed, the density unevenness may be lowered.

Figure 11:
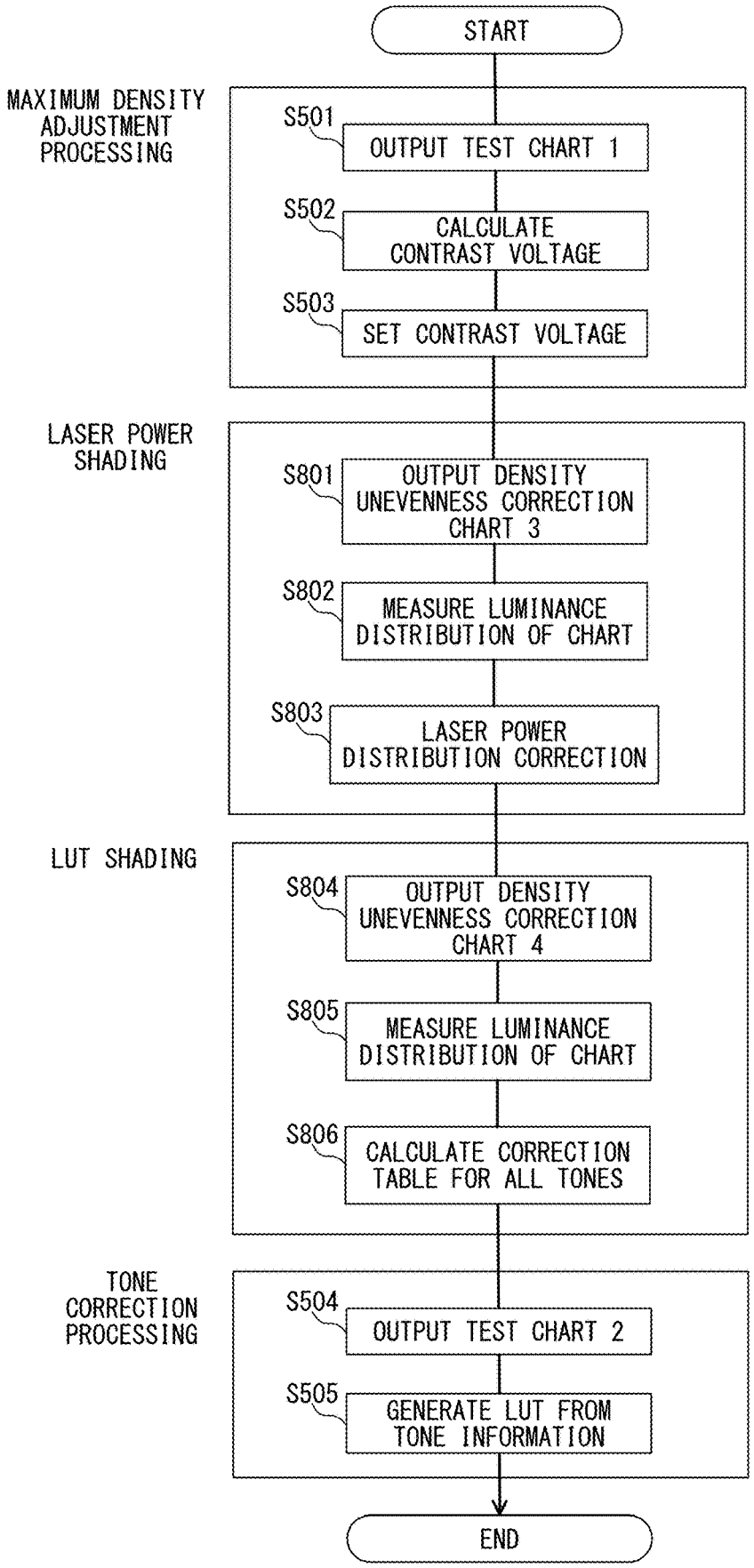
FIG. 11 is a flow chart representing a batch automatic adjustment process of a tone correction control and the density unevenness correction control.

FIG. 11 represents a batch automatic adjustment process which is performed when both the tone correction control and the density unevenness correction control are performed. In this batch automatic adjustment process, a performed process is a process which is different from that performed in a case where the tone correction control and the density unevenness correction control are performed independently. Specifically, as shown in FIG. 11, the density unevenness correction control (Steps S801 to S806) is performed after the maximum density adjustment process (Steps S501 to S503) in the tone correction control is performed. After that, the tone correction process (Steps S504 to S505) in the tone correction control is performed.

By performing the density unevenness correction control after executing a part of the tone correction control, that is, the maximum density adjustment process, at the time of outputting the test chart 2 for generating a monochromatic tone LUT in the tone correction control (Step S504), the density unevenness in the longitudinal direction of the photoconductor has already been eliminated. That is, the density unevenness correction control, which is a control that affects the tone correction process, is performed first, then, the tone correction process is performed. As a result, it is possible to prevent the tone shift caused by performing the density unevenness correction control after performing the one correction process. Further, the density unevenness in the longitudinal direction of the photoconductor is eliminated and the image in which the tone correction is performed with high accuracy can be obtained.

Further, since the density unevenness correction control in the longitudinal direction of the photoconductor has already been performed, it is not necessary to perform a patch averaging process in consideration of an in-plane unevenness at the time of the tone correction. Therefore, for example, it is not necessary to output a plurality of test charts 4 by changing the density stepwise. Further, it is possible to reduce the number of test charts required to correct the tone with a desired accuracy.

It should be noted that even in a case where the density unevenness correction control is simply performed first and then the tone correction control is performed, the density unevenness in the longitudinal direction of the photoconductor has been eliminated at the time of outputting the test chart 2, as in the example of FIG. 11. However, from a viewpoint of improving the accuracy of the density unevenness correction control, it is preferable to perform the density unevenness correction control after performing the maximum density adjustment process. Therefore, as shown in FIG. 11, it is preferable to perform the density unevenness correction control after performing the maximum density adjustment process.

Modification Example 1

In the above embodiment, in the tone correction control, in addition to the tone correction process, the maximum density adjustment process is performed. However, the present disclosure is not restricted to the maximum density adjustment process. In the modification example 1, in the tone correction control, after performing processes other than the tone correction process in advance, the tone correction process is performed. In this case, in the tone correction control, an arbitrary process to be performed before the tone correction process is performed as preprocessing. In the batch automatic adjustment processing, the density unevenness correction control is executed after the preprocessing in the tone correction control is executed first, then, the tone correction processing is performed. Also in the modification example 1, after the density unevenness in the longitudinal direction of the photoconductor of each gradation is eliminated, the test chart 2 is output (Step S504) and the LUT is generated (Step S505); therefore, the density unevenness in the longitudinal direction of the photoconductor is eliminated and it is possible to obtain an image in which the tone is corrected with high accuracy.

Modification Example 2

In the example represented in FIG. 10A and FIG. 10B, various correction processes are displayed on the operation panel 1801 and the user selects one of the correction processes as an individual adjustment. In the modification example 2, an example in which the user can select a plurality of correction processes is shown. In this case, the control part 70 determines whether or not both the automatic tone correction and the density unevenness correction are included in the correction process selected by the user input through the operation panel 1801. If neither the automatic tone correction nor the density unevenness correction is included, or only one of them is included, the control part 70 sequentially executes the selected correction process.

When the correction process selected by the user includes both the automatic tone correction and the density unevenness correction, the control part 70 performs 1) the tone correction control which corresponds to the automatic tone correction and 2) the density unevenness correction control which corresponds to the density unevenness correction control continuously. The process to be performed in this case is the same as the process shown in FIG. 11 in the above described embodiment. Therefore, after executing the maximum density adjustment processing (Steps S501 to S503) in the tone correction control, the density unevenness correction control (Steps S801 to S806) is executed, and then the tone correction process (Steps S504 to S505) in the tone correction control is performed.

The correction process selected by the user may include the automatic tone correction, the density unevenness correction, and a correction process which is different from both the automatic tone correction and the density unevenness correction (for example, front/back registration adjustment). In this case, the process represented in FIG. 11 may be executed after performing a correction process different from both the automatic tone correction and the density unevenness correction. Alternatively, after executing the process shown in FIG. 11, a correction process different from both the automatic tone correction and the density unevenness correction may be performed. Alternatively, after performing the maximum density adjustment processing (Steps S501 to S503), it is possible to perform the correction process different from both the automatic tone correction and the density unevenness correction, and thereafter, the tone correction process (Steps S504 to S505) is performed.

In the above-described embodiments and modifications 1 and 2, when the tone correction control is performed independently, two processes, i.e., 1) the maximum density adjustment process to calculate and set the contrast voltage by outputting test chart 1, and 2) the tone correction process to output the test chart 2 and generate the tone LUT to perform the tone correction are performed. When both the tone correction control and the density unevenness correction control are executed, the maximum density adjustment process, which is a part of the tone correction control process, is performed as the batch automatic adjustment process. After that, the density unevenness correction control including the laser power shading and the LUT shading is performed, and then, the tone correction process, which is the remaining process in the tone correction control, is performed. With such a configuration, it is possible to prevent the LUT generated by the tone correction process from being corrected as a result of the density unevenness correction control which decreases tone uniformity.

Further, according to the present disclosure, it is possible to provide the image forming apparatus which can perform density correction with high accuracy.

Although the embodiments of the present disclosure have been described above with reference to the drawings, the specific configuration is not limited to the above embodiments, and any changes or additions that do not depart from the subject of the present disclosure are included in this disclosure. For example, in the embodiment of the present disclosure, the exposure light source is described as a laser, however, the same applies to a solid-state light source. Although the front/back registration adjustment and the color tone correction are shown as individual adjustments in FIG. 10A and FIG. 10B, other adjustments such as a print position adjustment may be included in the individual adjustments. The control part 70 may be formed in the image forming apparatus 10, or may be formed in an information processing device connected to the image forming apparatus 10 by wire or wirelessly. Further, the function of the control part 70 may be provided through the cloud service.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-089374, filed May 27, 2021, which is hereby incorporated by reference herein in its entirety.

What is claimed is:

1. An image forming apparatus comprising:

an image processor configured to perform image processing on image data based on a conversion condition to output converted image data;

an image forming unit configured to form an image based on the converted image data output from the image processor, the image forming unit being controlled based on an image forming condition; and a controller configured to perform tone correction control, density evenness control, and total density control, which is a combination of the tone correction control and the density evenness control, wherein, in the tone correction control, the controller operates so as to:

control the image forming unit to form a first test image on a sheet;

obtain first reading data related to the first test image on the sheet;

determine the image forming condition based on the first reading data;

control the image forming unit based on the determined image forming condition to form a second test image on a sheet;

obtain second reading data related to the second test image on the sheet; and generate the conversion condition based on the second reading data, and wherein, in the density evenness control, the controller operates so as to:

control the image forming unit to form a third test image on a sheet;

obtain third reading data related to the third test image on the sheet; and control density evenness of an image to be formed by the image forming unit based on the third reading data, and wherein, in a case where the total density control is performed, the controller controls the image forming unit to form the third test image after the image forming condition is determined based on the first reading data and before the second test image is formed by the image forming unit.

2. An image forming apparatus comprising:

an image forming unit configured to:

form an electrostatic latent image on a photoconductor based on image data;

develop the formed electrostatic latent image to form an image; and transfer the formed image on a recording medium to form an image on the recording medium, and a control unit configured to perform a first control and second control, wherein the first control is a tone correction control which includes a tone correction process and preprocessing which is necessary to be performed before the tone correction process, wherein the tone correction process is a process in which a correction is performed to obtain an output tone value corresponding to a desired density for an input tone value with reference to the output tone value obtained by reading a test image formed on the recording medium corresponding to the input tone value, wherein the second control is a control including a process which affects the tone correction process, and wherein, in a case where an instruction to perform both the first control and the second control is input, the control unit is configured to:

perform the preprocessing before performing the second control; and perform the tone correction process after performing the second control.

3. The image forming apparatus according to claim 2, wherein the control unit is configured to perform, in a case where an instruction to perform a plurality of controls which include the first control and does not include the second control is input, the first control by:

performing the plurality of controls before performing the preprocessing; and performing the tone correction process after performing the preprocessing.

4. The image forming apparatus according to claim 2, wherein in a case where an instruction to perform a plurality of controls which include the first control and does not include the second control is input, the control unit is configured to:

perform the preprocessing before performing the plurality of controls; and perform the tone correction process after performing the plurality of controls.

5. The image forming apparatus according to claim 2, wherein the second control is a density unevenness correction control.

6. The image forming apparatus according to claim 2, wherein the preprocessing is a maximum density adjustment process.

7. The image forming apparatus according to claim 2, wherein the second control is a density unevenness correction control, wherein the preprocessing is a maximum density adjustment process, wherein the maximum density adjustment process is performed using a contrast, wherein the tone correction process is performed using an image signal value, and wherein the density unevenness correction control is performed using the output tone value obtained by reading the image formed on the recording medium corresponding to the input tone value.

8. The image forming apparatus according to claim 2, further comprising:

a correction data generating unit configured to generate correction data for correcting, for each tone, density unevenness of the photoconductor of the image forming unit in a longitudinal direction of the photoconductor; and a correction unit configured to correct, based on the correction data generated by the correction data generating unit, image data to be output to the image forming unit, wherein the correction data generating unit is configured to correct the density unevenness based on data obtained by measuring a density distribution in the longitudinal direction of the photoconductor of an image formed by the image forming unit by an image signal which is uniform in the longitudinal direction of the photoconductor, wherein the correction unit is configured to correct the density unevenness in the longitudinal direction of the photoconductor using the correction data to correct an image signal value such that the density unevenness in the longitudinal direction of the photoconductor for each tone is reduced, and wherein the correction data is generated based on a measurement result of the density of a predetermined image, which is formed in the image forming unit, having a plurality of tones in a rotation direction of the photoconductor.

9. The image forming apparatus according to claim 2, further comprising a display unit configured to display a selection screen which allows a user to select whether or not to perform automatic image adjustment, wherein, in a case where it is determined to select to perform the automatic image adjustment, the control unit is configured to:

perform the preprocessing before performing the second control; and perform the tone correction process after performing the second control.

10. The image forming apparatus according to claim 9, wherein the display unit is configured to:

display the selection screen which allows the user to select one of:

an individual adjustment in which the user can select a control from a plurality of controls including the first control; or an automatic adjustment of the image, wherein the control unit is configured to perform the first control by performing the tone correction process after executing the preprocessing in a case where the first control is selected in the individual adjustment.

* * * * *